US009573364B2

(12) United States Patent
Sumiyoshi

(10) Patent No.: US 9,573,364 B2
(45) Date of Patent: Feb. 21, 2017

(54) HEAD-DRIVING METHOD, HEAD-DRIVING DEVICE, AND INKJET PRINTING DEVICE

(71) Applicant: FUJIFILM Corporation, Tokyo (JP)

(72) Inventor: Yuta Sumiyoshi, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/677,711

(22) Filed: Apr. 2, 2015

(65) Prior Publication Data

US 2015/0210072 A1 Jul. 30, 2015

Related U.S. Application Data

(63) Continuation of application No. PCT/JP2013/077052, filed on Oct. 4, 2013.

(30) Foreign Application Priority Data

Oct. 9, 2012 (JP) ..... 2012-224166

(51) Int. Cl.
*B41J 2/15* (2006.01)
*B41J 2/045* (2006.01)

(52) U.S. Cl.
CPC ..... *B41J 2/04541* (2013.01); *B41J 2/0458* (2013.01); *B41J 2/04528* (2013.01); *B41J 2/04543* (2013.01); *B41J 2/04573* (2013.01); *B41J 2/04581* (2013.01); *B41J 2/04586* (2013.01)

(58) Field of Classification Search
CPC B41J 2/04581; B41J 2/04588; B41J 2/04593; B41J 2/04541; B41J 2/04591
See application file for complete search history.

(56) References Cited

U.S. PATENT DOCUMENTS 8,308,255 B2 * 11/2012 Sakai ..... G06K 15/102 347/11
2005/0225583 A1 10/2005 Ikemoto et al.
2007/0279449 A1 12/2007 Mori et al.

FOREIGN PATENT DOCUMENTS

| | | | |
|---|---|---|---|
| EP | 0630751 | A2 | 12/1994 |
| JP | 2003-320671 | A | 11/2003 |
| JP | 2005-066905 | | 3/2005 |
| JP | 2008-012909 | A | 1/2008 |
| JP | 2008-100483 | A | 5/2008 |
| JP | 2012-000834 | A | 1/2012 |

OTHER PUBLICATIONS

International Search Report; PCT/JP2013/077052; Jan. 7, 2014.
(Continued)

*Primary Examiner* — Lamson Nguyen
(74) *Attorney, Agent, or Firm* — Studebaker & Brackett PC

(57) ABSTRACT

A head-driving method includes outputting, to a plurality of head modules arranged in a recording head, nozzle control data via a data bus, wherein the data bus is shared between the plurality of head modules with the data being switched sequentially every bit, setting the nozzle control data for each head module to be supplied via the data bus as nozzle data for each of the head modules at a timing depending on each of the head modules, and outputting a drive voltage signal to an ejection energy generating element configured to eject liquid in each of the head modules.

6 Claims, 10 Drawing Sheets

(56) References Cited

OTHER PUBLICATIONS

Written Opinion of the International Searching Authority; PCT/JP2013/077052; Jan. 7, 2014.
Notification of Transmittal of Translation of the International Preliminary Report on Patentability and Translation of Written Opinion of the International Searching Authority; PCT/JP2013/077052; issued on Apr. 23, 2015.
The extended European search report issued by the European Patent Office on Nov. 11, 2016, which corresponds to European Patent Application No. 13844940.0-1704 and is related to U.S. Appl. No. 14/677,711.

* cited by examiner

RELATED ART

HEAD-DRIVING METHOD, HEAD-DRIVING DEVICE, AND INKJET PRINTING DEVICE

CROSS-REFERENCE TO RELATED APPLICATIONS

This application is a Continuation of PCT International Application No. PCT/JP2013/077052 filed on Oct. 4, 2013, which claims priority under 35 U.S.C §119(a) to Japanese Patent Application No. 2012-224166 filed on Oct. 9, 2012. Each of the above applications is hereby expressly incorporated by reference, in their entirety, into the present application.

BACKGROUND OF THE INVENTION

Field of the Invention

The present invention relates to a head-driving method, a head-driving device, and an inkjet printing device, and particularly to a head-driving method, a head-driving device, and an inkjet printing device for controlling an ejecting operation for a plurality of head modules.

Description of the Related Art

Japanese Patent Application Laid-Open No. 2003-320671 (PTL 1) discloses a printer head including one head chip in which a plurality of ink ejection mechanisms of the head chip are divided and grouped into a plurality of blocks which each have a predetermined number of the mechanisms and are dividedly driven simultaneously in parallel. PTL 1 discloses that a phase signal for dividedly driving the grouped ink ejection mechanisms is generated, and data for dividedly driving a grouped ink ejection mechanism is parallelized and serially transferred to reduce control signal lines on dividedly driving.

Japanese Patent Application Laid-Open No. 2005-066905 (PTL 2) discloses that, in specifying a drive timing for ejection energy generating means provided to an inkjet recording head in a time-sharing manner, the ejection energy generating means is specified in a time-sharing manner by a combination of bit signals supplied to control signal lines, a number of the signal lines being smaller than a time-sharing number, and thereby areas needed for forming the control signal lines are reduced as compared with a related art.

Japanese Patent Application Laid-Open No. 2012-000834 (PTL 3) discloses a head controller in which a data bus for transmitting nozzle control data from a data transfer control circuit to each head module is communalized among a plurality of head modules to reduce a number of IC pins of the data transfer control circuit, and wiring patterns on a circuit substrate.

SUMMARY OF THE INVENTION

The invention disclosed in PTL 1 has had a problem that a need to mount a serial-parallel conversion circuit on a drive circuit of the head causes complexity of processes in a decoder.

The invention disclosed in PTL 2 reduces a number of pieces of data (number of signal lines) input to the head by decoding the nozzle control data input to the head by many logical elements within the head to select the element to be ejected. However, a need of the logical elements for a decode circuit mounted on the head causes a need of many logical IC (Integrated Circuit). For this reason, the invention disclosed in PTL 2 has had a problem that size reduction of the head is difficult and manufacturing cost of the head increases.

In the invention disclosed in PTL 3, the bus for transferring respective pieces of image data ((HEAD a), (HEAD b)) corresponding to head modules a and b is communalized. As illustrated in FIG. 11, the pieces of image data ((HEAD a), (HEAD b)) of one cycle (e.g., 64 bits) corresponding to heads a and b, respectively, is serially transferred. A latch signal a ((e) of FIG. 11) is transferred when one cycle (e.g., 64 bits) of the image data (HEAD a) corresponding to the head module a is completely transferred, and a latch signal b ((f) of FIG. 11) is transferred when one cycle (e.g., 64 bits) of the image data (HEAD b) corresponding to the head module b is completely transferred ((d) of FIG. 11). This fixes the image data for a piezoelectric element in each of the head modules a and b. As illustrated in FIG. 11, in the invention disclosed in PTL 3, when two kinds of image data are transferred on one data bus, transfer clocks a and b ((b) and (c) of FIG. 11) are speeded up, which probably causes radiated noise to be generated to due to speed-up of the transfer clock.

The present invention has been made in consideration of such a circumstance, and has an object to provide a head-driving method capable of controlling a plurality of head modules by one head controller and capable of size reduction and cost reduction of the device, a head-driving device, and an inkjet printing device.

In order to achieve the above object, a head-driving method according to a first aspect of the invention includes a nozzle control data output step of outputting, to a plurality of head modules arranged in a recording head, nozzle control data for controlling an ejecting operation of nozzles in each of the head modules via a data bus shared between the plurality of head modules with the data being switched sequentially every bit, a nozzle control data setting step of setting the nozzle control data for each head module to be supplied via the data bus to each of the head modules as nozzle data for each of the head modules by outputting a data latch signal at a timing depending on each of the head modules, and a driving step of outputting a drive voltage signal to an ejection energy generating element for ejecting liquid in each of the head modules to drive the ejection energy generating element.

According to the first aspect, the data bus for supplying the nozzle control data to the plurality of head modules is shared, allowing size reduction and cost reduction of the device to be achieved.

A head-driving method according to a second aspect of the invention includes, in addition to the first aspect, a step of varying a phase of a transfer clock when transferring the nozzle control data to the head module correspondingly to every head module.

According to the second aspect, the transfer clock having a phase different from one head module to another is used to allow the nozzle control data to be switched sequentially every bit. This can suppress occurrence of a radiated noise caused by the speeded-up transfer clock.

A head-driving method according to a third aspect of the invention includes, in addition to the first aspect, a step of generating N transfer clocks in which in a case where a number of the head modules is N (N is an integer and $N \geq 2$), a period for one clock is equal to a transfer time period required for the nozzle control data of N bits, and the N transfer clocks have phases different from each other corresponding to the N head modules.

A head-driving method according to a fourth aspect of the invention includes, in addition to the first aspect, a step of reversing a phase of the transfer clock when transferring the nozzle control data to two head modules in a case where a number of the head modules is two.

In a head-driving method according to a fifth aspect of the invention, in the driving step according to the first to fourth aspects, the drive voltage signal is applied to the plurality of head modules, the signal being common to the modules.

According to the fifth aspect, the drive voltage signal is made common to the plurality of head modules, further simplifying a circuit configuration. This allows the further size reduction and cost reduction of the device to be achieved.

A head-driving device according to a sixth aspect of the invention which is connected with a recording head having a plurality of head modules arranged thereon, each module having a plurality of nozzles and ejection energy generating elements corresponding to the respective nozzles, to control droplet ejection from the nozzles of the recording head, the head-driving device includes a data transfer control circuit configured to output, to the plurality of head modules, nozzle control data for controlling an ejecting operation of the nozzles in each of the head modules with the data being switched sequentially every bit, a data bus that is shared as a signal transmission line between the plurality of head modules, the signal transmission line transmitting a signal of the nozzle control data output from the data transfer control circuit to the plurality of head modules, the signal being common to the modules, a latch signal transmission circuit configured to output a data latch signal at a timing depending on the head module in order to set the nozzle control data for each head module which is supplied from the data transfer control circuit via the data bus to each of the head modules, the data being is common to the modules, as the nozzle control data of the relevant head module, and a drive voltage output circuit configured to output a drive voltage signal for driving the ejection energy generating element of each of the head modules.

In the head-driving device according to a seventh aspect of the invention, in the sixth aspect, the data transfer control circuit varies a phase of a transfer clock when transferring the nozzle control data to the head module correspondingly to every head module.

In the head-driving device according to an eighth aspect of the invention, in the sixth aspect, the data transfer control circuit generates N transfer clocks in which in a case where a number of the head modules is N (N is an integer and $N \geq 2$), a period for one clock is equal to a transfer time period required for the nozzle control data of N bits, and the N transfer clocks have phases different from each other corresponding to the N head modules.

In the head-driving device according to a ninth aspect of the invention, in the sixth aspect, the data transfer control circuit reverses a phase of the transfer clock when transferring the nozzle control data to two head modules in a case where a number of the head modules is two.

In the head-driving device according to a tenth aspect of the invention, in the sixth to ninth aspects, the drive voltage output circuit applies the drive voltage signal to the plurality of head modules, the signal being common to the modules.

An inkjet printing device according to an eleventh aspect of the invention includes the head-driving device according to the sixth to tenth aspects, and the recording head.

According to the present invention, a plurality of head modules can be controlled by one head controller, achieving size reduction and cost reduction of the device.

DETAILED DESCRIPTION OF EXEMPLARY EMBODIMENTS

Hereinafter, a description is given of an embodiment of a head-driving method, a head-driving device, and an inkjet printing device according to the invention with reference to the drawings.

[Head-Driving Device]

Figure 1:
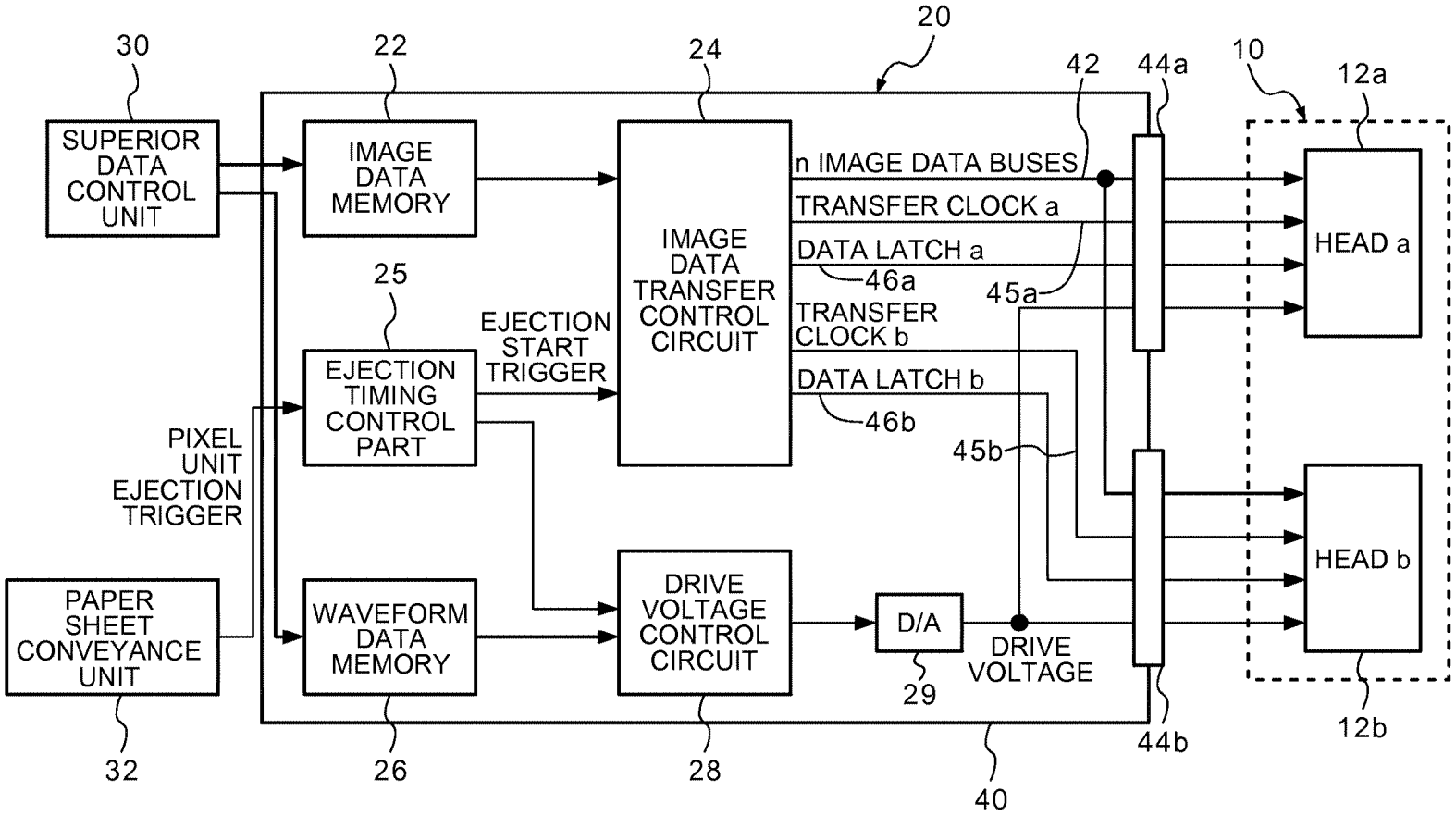
FIG. 1 is a block diagram illustrating a configuration of a head-driving device in an inkjet printing device according to an embodiment of the invention.

FIG. 1 is a block diagram illustrating a configuration of a head-driving device in an inkjet printing device according to an embodiment of the invention.

A print head (corresponding to "recording head") 10 includes a plurality of inkjet head modules (hereinafter, referred to as "head module(s)") 12*a* and 12*b*. In this embodiment, a number of the head modules 12*a* and 12*b* (head a and head b) is two, but the number of the head modules included in one print head 10 is not specifically limited.

The head modules 12*a* and 12*b* each have an ink ejection surface on which a plurality of nozzles (ink ejection outlet) is highly densely arranged in a two-dimensional form. The head modules 12*a* and 12*b* are provided with an ejection energy generating element (piezoelectric element in this embodiment) corresponding to each nozzle.

Combining a plurality of head modules 12*a* and 12*b* along a width direction of a paper sheet (not illustrated) which is an image formation receiving medium allows to a long line head (page-wide head capable of single-pass printing) to be formed, the long line head having a nozzle row capable of image formation at a predetermined recording resolution (e.g., 1200 dpi (dot per inch)) in an entire recordable range (full width capable of image formation) in a paper width direction.

A head control unit 20 (corresponding to "head-driving device") connected with the print head 10 controls driving of a piezoelectric element corresponding to each of nozzles of a plurality of head modules 12*a* and 12*b* to control an operation of ink ejection (whether or not to eject, droplet ejection amount) from the nozzle.

The head control unit 20 includes an image data memory 22, image data transfer control circuit 24 (corresponding to "data transfer control circuit"), ejection timing control part 25, waveform data memory 26, drive voltage control circuit 28 (corresponding to "drive voltage output circuit"), and D/A converter 29. In this embodiment, the image data transfer control circuit 24 includes a "latch signal transmission circuit", and therefore, data latch signals are output at an appropriate timing from the image data transfer control circuit 24 to the head modules 12*a* and 12*b*.

The image data memory 22 stores therein image data which is developed into print image data (dot data). The waveform data memory 26 stores therein digital data of drive voltage waveform for driving the piezoelectric element. The image data stored in the image data memory 22 and the waveform data input to the waveform data memory 26 are managed by superior data control unit 30 (corresponding to "superior data control device"). The superior data control unit 30 may be constituted by a personal computer or a host computer, for example. The head control unit 20 includes a communication interface (e.g., USB (Universal Serial Bus)) as data communication means configured to receive data from the superior data control unit 30.

FIG. 1 illustrates only one print head 10 (for one color) for the purpose of easy explanation. In a case of the inkjet printing device including a plurality of print heads (for respective colors) corresponding to respective colors of ink of a plurality of colors, the head control unit 20 is individually provided for the print head 10 of each color (in terms of the head). Then, the head control units 20 for these respective colors are managed by one superior data control unit 30. For example, in a configuration including the print heads for the respective colors corresponding to four colors of cyan (C), magenta (M), yellow (Y), and black (K), a configuration is employed in which the head control unit 20 is provided to the print head for each of CMYK colors, and the head control units for the respective colors are managed by one superior data control unit 30.

On start-up of the system, the waveform data and the image data are transferred from the superior data control unit 30 to the head control units 20 for the respective colors. As for the image data, data transfer may be carried out in synchronization with paper sheet conveyance during printing. During a printing operation, the ejection timing control part 25 for each color receives an ejection trigger signal (pixel unit ejection trigger) from a paper sheet conveyance unit 32, and outputs an ejection start trigger for starting an ejecting operation to the image data transfer control circuit 24 and the drive voltage control circuit 28. The image data transfer control circuit 24 and the drive voltage control circuit 28, in response to reception of the ejection start trigger transfer the waveform data and image data in terms of resolution to the head modules 12*a* and 12*b*. This carries out the ejecting operation selective depending on the image data (on-demand ejection drive control) to attain printing of one page.

The drive voltage control circuit 28 outputs drive voltage waveform data to the D/A converter 29 in time with the ejection start trigger (print timing signal, ejection trigger signal). This converts the drive voltage waveform data into an analog voltage waveform by the D/A converter 29. The analog voltage waveform output from the D/A converter 29 is amplified into a predetermined current/voltage suitable for driving the piezoelectric element by an amplifier circuit not illustrated in the figure (power amplifier circuit), followed by being supplied to the head modules 12*a* and 12*b*.

In this embodiment, the drive voltage waveform data is supplied in common to the head modules 12*a* and 12*b*, but the drive voltage waveform data different for each of the head modules 12*a* and 12*b* may be used. In this case, the drive voltage waveform data depending on individual differences of the head modules 12*a* and 12*b* is used to enable higher quality of image formation.

Figure 2:
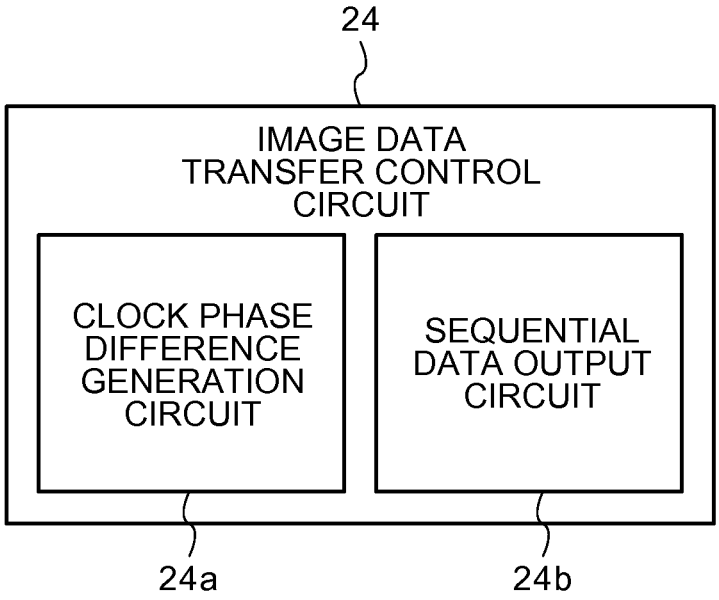
FIG. 2 is a block diagram illustrating a configuration of an image data transfer control circuit.

The image data transfer control circuit 24 may include, for example, a CPU (Central Processing Unit), an FPGA (Field Programmable Gate Array). As illustrated in FIG. 2, the image data transfer control circuit 24 includes a clock phase difference generation circuit 24*a* and a sequential data output circuit 24*b*. The sequential data output circuit 24*b* in the image data transfer control circuit 24 controls transfer of the nozzle control data of the head modules 12*a* and 12*b* (here, image data corresponding to a dot arrangement of the recording resolution) to the head modules 12*a* and 12*b* on the basis of the data stored in the image data memory 22. The nozzle control data is image data (dot data) for determining ON (ejection drive)/OFF (non-drive) of the nozzle. The image data transfer control circuit 24 transfers this nozzle control data to the head modules 12*a* and 12*b* to control open and close (ON/OFF) for each nozzle.

An image data transmission line (reference numeral 42) transmits the nozzle control data output from the image data transfer control circuit 24 to the head modules 12*a* and 12*b*. The image data transmission line (reference numeral 42) is referred to as "image data bus", "data bus" or "image bus", and constituted by a plurality of signal lines (n lines) ($n \geq 2$). In this embodiment, hereinafter, the image data transmission line is referred to as "data bus" (reference numeral 42).

The data bus 42 transmits the image data from the image data transfer control circuit 24 to the print head 10. In other words, the data bus 42 is shared as the image data transmission line to a plurality of head modules 12*a* and 12*b*. One end of the data bus 42 is connected with an output terminal (IC pin) of the image data transfer control circuit 24, and the other end is branched before the head modules 12*a* and 12*b* (branched before connectors 44*a* and 44*b* respectively corresponding to the head modules 12*a* and 12*b*), the branched shared data bus 42 being connected in parallel with a plurality of head modules 12*a* and 12*b*.

The data bus 42 may be configured by using a wiring pattern of an electric circuit substrate 40 mounting thereon the image data transfer control circuit 24, the drive voltage control circuit 28 and the like, or may be configured by using a wire harness, or may be a combination of these. In this way, the data bus 42 is connected with the head modules 12*a* and 12*b* with the IC pin of the image data transfer control circuit 24 being as a signal source.

In this embodiment, the data bus 42 is communalized for a plurality of head modules 12*a* and 12*b* which are to be controlled by one head control unit 20 (a section from a connection point between the image data transfer control circuit 24 and the IC pin to the branch point of the parallel connection is physically shared). This attains reduction of the IC pin of the image data transfer control circuit 24, and the wiring pattern (signal line) of the electric circuit substrate 40.

As illustrated in FIG. 1, signal lines 45*a* and 45*b* for transfer clocks are individually provided correspondingly to the head modules 12*a* and 12*b*, respectively. The clock phase difference generation circuit 24*a* in the image data transfer control circuit 24 can input transfer clocks a and b different in the phase via the signal lines 45*a* and 45*b* to the head modules 12*a* and 12*b*, respectively.

In this embodiment, signal lines 46*a* and 46*b* for data latch signals are individually provided correspondingly to the head modules 12*a* and 12*b*, respectively. The data latch signal is transmitted from the image data transfer control circuit 24 to each of the head modules 12*a* and 12*b* at a timing needed in order to set data signal transferred via the data bus 42 as nozzle data for the head modules 12*a* and 12*b*. At the time when a certain amount of the image data is transmitted from the image data transfer control circuit 24 via the data bus 42 to the head modules 12*a* and 12*b*, a signal called a data latch (latch signal, data latches a and b) is transmitted to each of the head modules 12*a* and 12*b*. At the timing of this data latch signal, on (ON)/off (OFF) data of displacement for the piezoelectric element of each module is fixed. After that, drive voltages a and b are applied to the head modules 12*a* and 12*b*, respectively, to displace the piezoelectric element associated with ON setting by a minute amount and eject the ink droplet. The ink droplet ejected in this way is attached (deposited) on the paper sheet to perform printing at a desired resolution (e.g., 1200 dpi). The piezoelectric element set to OFF setting, even though subjected to application of the drive voltage, is not displaced, and thus, the droplet is not ejected.

[Control Method for Head]

Figure 3:
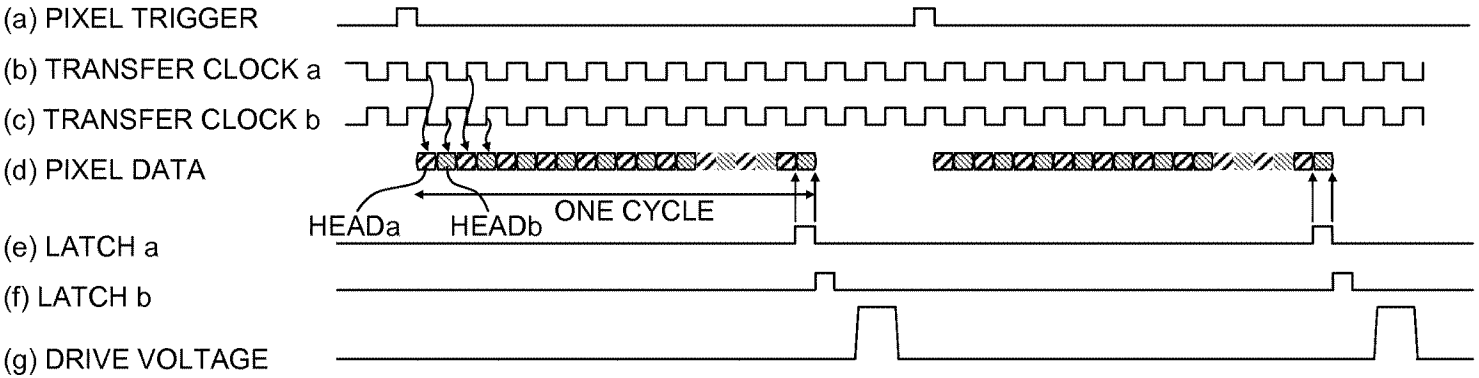
FIG. 3 is a timing chart illustrating a head-driving method according to an embodiment of the invention.

FIG. 3 is a timing chart illustrating a head-driving method according to an embodiment of the invention.

As illustrated in FIG. 3, the image data (nozzle control data) is sent via the common data bus 42 to each of the head modules 12*a* and 12*b* in accordance with an ejection trigger in pixel unit ("pixel trigger" described in (a) of FIG. 3) in a time-sharing manner (see (d) of FIG. 3).

In this embodiment, the data bus 42 for transferring the image data to a plurality of head modules 12*a* and 12*b* is used in common. For this reason, two kinds of image data (image data (HEAD a) applied for the head module 12*a* and image data (HEAD b) applied for the head module 12*b*) are transferred on one data bus 42 in a time-sharing manner (see (d) of FIG. 3).

The data latch a ((e) of FIG. 3) is a latch signal to fix the data for the piezoelectric element (nozzle) in the head module 12*a*. The data latch b ((f) of FIG. 3) is a latch signal to fix the data for the piezoelectric element (nozzle) in the head module 12*b*. These data latch signals a/b are transferred when the image data ((HEAD a) and (HEAD b)) of the respective head modules 12*a* and 12*b* is completely transferred.

The head modules 12*a* and 12*b* are supplied with the transfer clocks a and b illustrated in (b) and (c) of FIG. 3, respectively. An interval between rising positions of pulses adjacent to each other in the transfer clocks a and b is equal to a time period required for transferring the image data of two bits. The transfer clocks a and b have the phases reversed to each other.

As illustrated in (d) of FIG. 3, the image data (HEAD a) applied to the head module 12*a* and the image data (HEAD b) applied to the head module 12*b* are alternately transferred to the data bus 42. Then, the image data (HEAD a) applied to the head module 12*a* is caught at a rising timing of the transfer clock a and the image data (HEAD b) applied to the head module 12*b* is caught at a rising timing of the transfer clock b.

After transferring of the image data (HEAD a) and (HEAD b) is repeated, as illustrated in (e) of FIG. 3, when the image data (HEAD a) of one cycle is completely transferred to the head module 12*a*, the data latch a is given to fix the data for the head module 12*a*. Further, as illustrated in (f) of FIG. 3, when the image data (HEAD b) of one cycle is completely transferred to the head module 12*b*, the data latch b is given to fix the data for the head module 12*b*.

In this way, the piezoelectric element ON/OFF data of the head module 12*a* is fixed by the latch signal of the data latch a, and the piezoelectric element ON/OFF data of the head module 12*b* is fixed by the latch signal of the data latch b. After that, the drive voltages are applied at the same timing to the head modules 12*a* and 12*b* (see (g) of FIG. 3). By way of application of this drive voltage, the droplets are ejected from the nozzles in the head modules 12*a* and 12*b* specified by the image data (HEAD a) and (HEAD b) to carry out the image formation and recording. The above processing cycle is repeated at a timing of conveying the paper sheet to perform printing.

[Circuit Configuration of Head Module]

Figure 4:
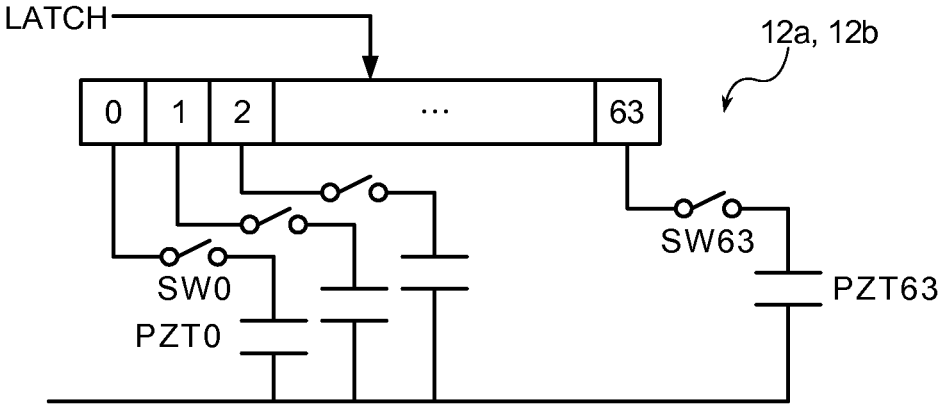
FIG. 4 is an illustration schematically illustrating a configuration of a circuit of a head module.

FIG. 4 is an illustration schematically illustrating a configuration of a circuit of the head module.

In an example illustrated in FIG. 4, the image data of 64 bits for 16 cycles is respectively input to registers (0, . . . , 63) of the head modules 12*a* and 12*b*. In other words, in this case, assuming the number n of image data bus is n=16.

As illustrated in FIG. 4, when the image data of 64 bits for one cycle is respectively input to the registers (0, . . . , 63) of the head modules 12*a* and 12*b*, the data latches a and b are input. This fixes the ON/OFF data for the piezoelectric elements PZT0, . . . , PZT63 of the head modules 12*a* and 12*b*. After that, the drive voltages are applied to the head modules 12*a* and 12*b*, the droplets are ejected from the nozzles in the head modules 12*a* and 12*b* specified by the image data (HEAD a) and (HEAD b) to carry out image formation and recording.

For example, when "1" is input to the registers (0, . . . , 63), switches (SW0, . . . , SW63) corresponding to the respective registers (0, . . . , 63) are closed to activate the piezoelectric elements (PZT0, . . . , PZT63) corresponding to the switches (SW0, . . . , SW63). This allows the nozzles corresponding to the piezoelectric elements (PZT0, . . . , PZT63) to eject the droplets.

As already described above, the number of the head modules is not limited to two. In a case where the number of the heads is N (N is an integer and N≥2), the clock phase difference generation circuit 24*a* first generates a reference clock whose interval (one clock) between rising positions adjacent to each other is equal to a time interval for transferring the image data of one bit. Here, the reference clock is generated by, for example, by dividing or multiplying a source oscillation clock (input or the like from a crystal oscillator) given to the image data transfer control circuit 24 (e.g., FPGA). Then, the clock phase difference generation circuit 24*a* divides this reference clock into N parts such that a frequency becomes 1/N of the reference clock (The time interval between the rising positions becomes multiplied N-fold. One clock becomes equal to a time period required for transferring the image data of N bits.). The clock phase difference generation circuit 24*a* shifts the phase such that a rising edge of the reference clock after N parts-dividing matches each transfer start position of the image data to generate N transfer clocks. This may attain phase correction for this transfer clock by a PLD (Programmable Logic Device) device design (FPGA or the like). In other words, so long as a transmission rate is speeded up, and transfer waveform quality and data transfer timing specification are satisfied, a plurality of heads can be controlled on the same bus.

Figure 5:
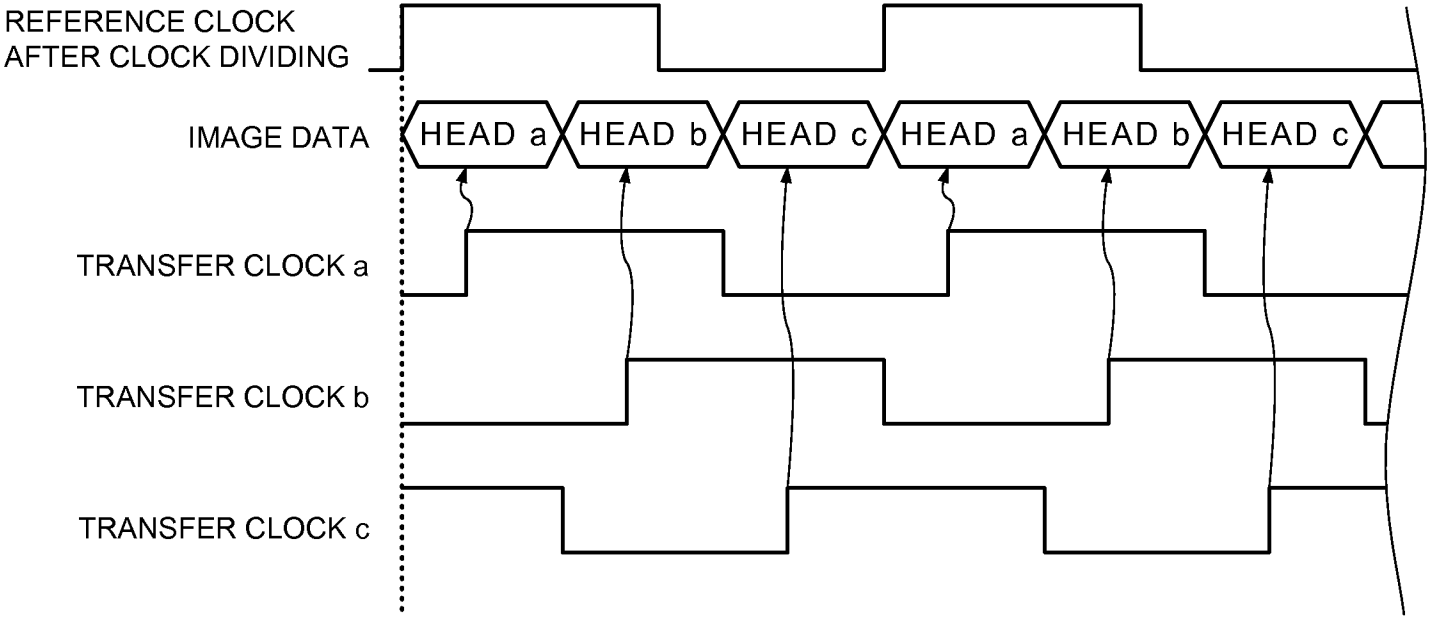
FIG. 5 is a timing chart in a case where a number of head modules is three.

FIG. 5 is a timing chart in a case where the number of the head modules is three.

In the case of three head modules 12*a*, 12*b*, and 12*c*, the clock phase difference generation circuit 24*a* divides the reference clock into three parts. As illustrated in FIG. 5, an interval (one clock) between the rising positions of the pulses adjacent to each other in the reference clock after clock dividing is equal to a transfer time period from when the image data (HEAD a) is transferred to when the next image data (HEAD a) is transferred (transfer time period required for the image data of three bits). Next, the clock phase difference generation circuit 24*a* shifts the rising position of the above reference clock after clock dividing to generate the transfer clocks a, b, and c whose rising positions match transfer start times of the image data (HEAD a), (HEAD b), and (HEAD c). This generates the transfer clocks a, b, and c corresponding to the head modules 12*a*, 12*b*, and 12*c*, respectively.

The data bus 42 receives the image data (HEAD a) applied to the head module 12*a*, the image data (HEAD b) applied to the head module 12*b*, the image data (HEAD c) applied to the head module 12*c* which are sequentially and repeatedly transferred by the sequential data output circuit 24*b*. Then, the image data (HEAD a) applied to the head module 12*a* is caught at the rising timing of the transfer clock a. The image data (HEAD b) applied to the head module 12*b* is caught at rising timing of the transfer clock b, and the image data (HEAD c) applied to the head module 12*c* is caught at the rising timing of the transfer clock c. This makes it possible to control three head modules 12*a*, 12*b*, and 12*c* by one head control unit.

In this embodiment, the image data of the head modules (12*a*, 12*b*, 12*c*) is transferred in this order, but the data transfer order is not limited thereto. The image data transfer order may be set independently (arbitrarily) of arrangement sequence of the head module.

In this embodiment, at the rising timings of the transfer clocks a, b, and c, the image data applied to the head module 12*a* ((HEAD a), (HEAD b), and (HEAD c), respectively) is caught, but at timings when the transfer clocks a, b, and c fall, the image data applied to the head module 12*a* ((HEAD a), (HEAD b), and (HEAD c), respectively) may be caught.

[Configuration of Inkjet Printing Device]

Figure 6:
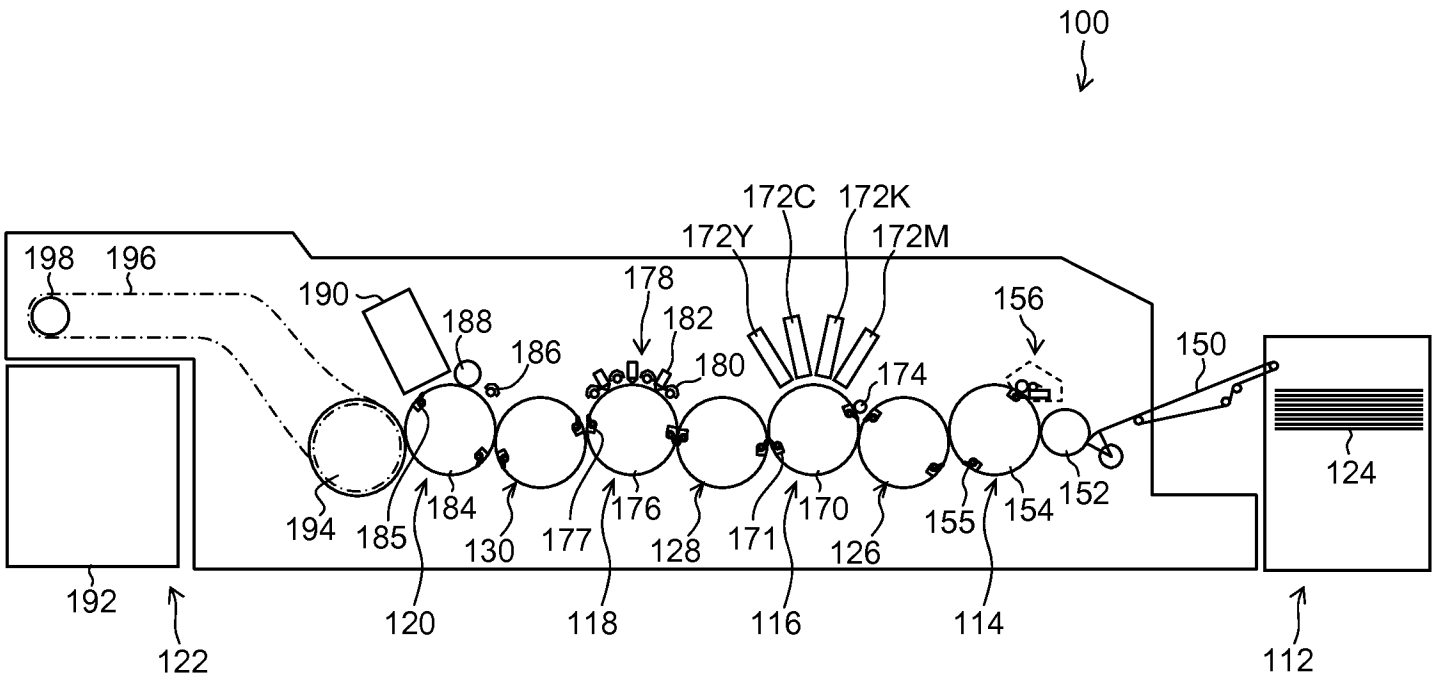
FIG. 6 is a general configuration diagram illustrating the inkjet printing device according to an embodiment of the invention.

FIG. 6 a general configuration diagram illustrating the inkjet printing device according to an embodiment of the invention.

An inkjet printing device 100 illustrated in FIG. 6 includes a paper feed unit 112, treatment liquid deposition unit (pre-coating unit) 114, image formation unit 116, drying unit 118, fixing unit 120, and a paper output unit 122. The inkjet printing device 100 is a single-pass system inkjet printing device which ejects and deposits droplets of ink of a plurality of colors from inkjet heads 172M, 172K, 172C, and 172Y onto a recording medium 124 (corresponding to "image formation receiving medium", hereinafter, sometimes referred to as "paper sheet" for the sake of convenience) held on a pressure drum (image formation drum 170) of the image formation unit 116 to form a desired color image. The inkjet printing device 100 is an on-demand type inkjet printing device adopting a two-liquid reaction (aggregation) method in which an image is formed on the recording medium 124 by depositing a treatment liquid (here, aggregation treatment liquid) onto the recording medium 124 before depositing droplets of ink to cause the treatment liquid and ink liquid to react to each other.

(Paper Feed Unit)

The recording medium 124 as printer sheet is stacked in the paper feed unit 112. The recording medium 124 is fed sheet by sheet from a paper feed tray 150 of the paper feed unit 112 to the treatment liquid deposition unit 114. In this embodiment, the printer sheet (cut sheet) is used as the recording medium 124, but continuous paper (roll paper) may be cut into a needed size and fed.

(Treatment Liquid Deposition Unit)

The treatment liquid deposition unit 114 deposits the treatment liquid onto a recording surface of the recording medium 124. The treatment liquid contains a coloring material aggregating agent which aggregates a coloring material (e.g., pigment) in the ink deposited by the image formation unit 116. This treatment liquid and the ink are brought into contact with each other to promote separation of the coloring material and solvent in the ink.

The treatment liquid deposition unit 114 includes a paper feed drum 152, treatment liquid drum (also referred to as "pre-coating drum") 154, and treatment liquid application device 156. The treatment liquid drum 154 is a drum which holds the recording medium 124 to be rotationally conveyed. The treatment liquid drum 154 has claw-shaped grip means (gripper) 155 provided on an outer circumferential surface thereof. The recording medium 124 is sandwiched between the claw of the grip means 155 and the circumferential surface of the treatment liquid drum 154 such that a leading end of the recording medium can be gripped. The treatment liquid drum 154 may have suction holes formed on the outer circumferential surface thereof and be connected with suction means for suction through the suction holes. This allows the recording medium 124 to be tightly held on the circumferential surface of the treatment liquid drum 154.

The treatment liquid application device 156 is disposed on the outside of the treatment liquid drum 154 so as to face the circumferential surface of the drum 154. The treatment liquid application device 156 includes a treatment liquid container in which the treatment liquid is reserved, an anilox roller (measuring roller) a part of which is immersed in the treatment liquid in the treatment liquid container, and a rubber roller which is pressed against the anilox roller and the recording medium 124 on the treatment liquid drum 154 to transfer the measured treatment liquid to the recording medium 124. This treatment liquid application device 156 can apply, while measuring, the treatment liquid to recording medium 124.

In this embodiment, a configuration is described which adopts the application system using the roller, but is not limited thereto. For example, various other methods, such as a spray method, an inkjet method, or the like can be adopted as the application method of the treatment liquid.

The recording medium 124 onto which the treatment liquid is deposited by the treatment liquid deposition unit 114 is passed from the treatment liquid drum 154 via an intermediate conveyance unit 126 to the image formation drum 170 of the image formation unit 116.

(Image Formation Unit)

The image formation unit 116 includes the image formation drum (also referred to as "jetting drum") 170, paper sheet pressing roller 174, and inkjet heads 172M, 172K, 172C, and 172Y. As the inkjet heads 172M, 172K, 172C, and 172Y of respective colors and the control unit therefor, the configuration of the print head 10 and the configuration of the head control unit 20 illustrated in FIG. 1 are employed.

The image formation drum 170 has claw-shaped grip means (gripper) 171 provided on an outer circumferential surface thereof similarly to the treatment liquid drum 154. The recording medium 124 held on the image formation drum 170 is conveyed with the recording surface facing outward such that the ink is deposited onto the recording surface from the inkjet heads 172M, 172K, 172C, and 172Y.

The inkjet heads 172M, 172K, 172C, and 172Y each are a full-line type inkjet recording head having a length corresponding to a maximum width of the image formed region on the recording medium 124. Each of the inkjet heads 172M, 172K, 172C, and 172Y has the ink ejection surface on which formed is a nozzle row of a plurality of nozzles for ink ejection arranged (two-dimensionally arranged nozzles) throughout the whole width of the image formed region. The inkjet heads 172M, 172K, 172C, and 172Y each are disposed so as extend in a direction perpendicular to a conveying direction (direction of rotation of the image formation drum 170) of the recording medium 124.

To each of the inkjet heads 172M, 172K, 172C, and 172Y, a corresponding color ink cassette is attached thereto. The ink droplets are ejected from the inkjet heads 172M, 172K, 172C, and 172Y toward the recording surface of the recording medium 124 held on the outer circumferential surface of the image formation drum 170.

This brings the ink into contact with the treatment liquid which is deposited in advance onto the recording surface to cause the coloring material (pigment) dispersed in the ink to be aggregated to form a coloring material aggregate. In this embodiment, as an example of reaction between the ink and the treatment liquid, a mechanism is used where acid is contained in the treatment liquid to break the pigment dispersion so as to be aggregated due to PH (power of Hydrogen) in order to prevent coloring material bleeding, color mixture of the inks, and interference with the droplet deposition caused by liquid coalescence in depositing the ink droplets. In this way, the coloring material flowing on the recording medium 124 and the like are prevented, and the image is formed on recording surface of the recording medium 124.

Droplet deposition timings of the inkjet heads 172M, 172K, 172C, and 172Y are synchronized with an encoder (not illustrated in FIG. 6, reference numeral 294 in FIG. 10) which is arranged in the image formation drum 170 and detects a rotation speed. The ejection trigger signal (pixel trigger) is emitted on the basis of a detection signal of the encoder. This makes it possible to determine a deposited position with a high accuracy. Moreover, speed variation due to a wobble of the image formation drum 170 or the like is learned in advance to correct the droplet deposition timing obtained by the encoder such that droplet deposition non-uniformity can be reduced independently of the wobble of the image formation drum 170, accuracy of a rotary shaft, and a speed of the outer circumferential surface of the image formation drum 170.

A maintenance operation such as cleaning of the nozzle surfaces of the inkjet heads 172M, 172K, 172C, and 172Y, and discharge of thickened ink may be carried out after taking away a head unit from the image formation drum 170.

In this embodiment, a CMYK standard color (four colors) configuration is described, but combinations of ink colors and numbers of colors are not limited thereto. Light inks, dark inks, and special color inks may be added as needed. For example, a configuration is possible in which inkjet heads are added that eject the light inks such as light cyan, and light magenta, and an arrangement order of the heads for the colors is not specifically limited.

The recording medium 124 on which an image has been formed in the image formation unit 116 is passed from the image formation drum 170 via the intermediate conveyance unit 128 to a drying drum 176 of the drying unit 118.

(Drying Unit)

The drying unit 118 is a mechanism for drying water contained in the solvent which has been separated by the coloring material aggregation action, and includes the drying drum 176 and a solvent drying device 178 as illustrated in FIG. 6. The drying drum 176 has claw-shaped grip means (gripper) 177 provided on an outer circumferential surface thereof similarly to the treatment liquid drum 154. The grip means 177 can hold the leading end of the recording medium 124.

The solvent drying device 178 is arranged at a position to face an outer circumferential surface of the drying drum 176 and includes a plurality of halogen heaters 180 and warm-air blow-out nozzles 182 each arranged between adjacent two of the halogen heaters 180. A temperature and flow rate of a warm air blowing from each warm-air blow-out nozzle 182 toward the recording medium 124 and temperatures of the halogen heaters 180 may be adequately adjusted to attain various drying conditions.

The recording medium 124 is held on the outer circumferential surface of the drying drum 176 with the recording surface of the recording medium 124 facing outward (that is, in a state where the recording surface of the recording medium 124 is curved in a convex shape) and is rotationally conveyed while being dried. This can prevent wrinkles or coming-off of the recording medium 124 from occurring, and therefore drying non-uniformities caused by these phenomena can be prevented reliably.

The recording medium 124 having been subjected to a dry treatment in the drying unit 118 is passed from the drying drum 176 via the intermediate conveyance unit 130 to a fixing drum 184 of the fixing unit 120.

(Fixing Unit)

The fixing unit 120 includes the fixing drum 184, halogen heater 186, fixing roller 188, and in-line sensor 190. The fixing drum 184 has claw-shaped grip means (gripper) 185 provided on an outer circumferential surface thereof similarly to the treatment liquid drum 154 such that the grip means 185 can hold the leading end of the recording medium 124.

By means of rotation of the fixing drum 184, the recording medium 124 is conveyed with the recording surface facing outward. Then, the recording surface of the recording medium 124 undergoes preliminary heating by the halogen heater 186, a fixing treatment by the fixing roller 188, and inspection by the in-line sensor 190.

The halogen heater 186 is controlled to be at a predetermined temperature (e.g., 180° C.). This allows the recording medium 124 to undergo the preliminary heating.

The fixing roller 188 is a roller member which heats and pressurizes the dried ink to melt and fix self-dispersing polymer particles in the ink for transforming the ink into a film. The fixing roller 188 heats and pressurizes the recording medium 124. Specifically, the fixing roller 188 is disposed so as to press against the fixing drum 184, and a nip roller is configured between the fixing roller 188 and the fixing drum 184. This causes the recording medium 124 to be sandwiched between the fixing roller 188 and the fixing drum 184 to be nipped at a predetermined nip pressure (e.g., 0.15 MPa), whereby the fixing treatment is carried out.

The fixing roller 188 is constituted by a heating roller formed by a pipe of metal having good thermal conductivity, such as aluminum, which internally incorporates a halogen lamp, and is controlled to a prescribed temperature (e.g. 60 to 80° C.). The heating roller heats the recording medium 124 to give thermal energy equal to or greater than the Tg temperature (glass transition temperature) of the latex contained in the ink, causing the latex particles to melt. This subjects projections-recessions in the recording medium 124 to fixing by pressure, as well as projections-recessions of the image surface to leveling, obtaining a glossy finish.

The embodiment of FIG. 6 illustrates a configuration where only a single fixing roller 188 is provided, but the configuration may have a plurality of stages provided depending on a thickness of an image layer and the Tg characteristics of the latex particles.

On the other hand, the in-line sensor 190 is readout means configured to measure ejection defect checking pattern, image density, image defects and the like regarding the image recorded on the recording medium 124 (including a test pattern or the like), to which sensor 190 a CCD (Charge Coupled Device) line sensor or the like is applied.

According to the fixing unit 120 configured as described above, the latex particles in a thin image layer formed by the drying unit 118 are heated and pressurized by the fixing roller 188 to be melted, allowing steady fixing onto the recording medium 124.

Instead of the ink containing a high-boiling-point solvent and polymer particles (thermoplastic resin particles), it is also possible to include a monomer which can be polymerized and cured by exposure to ultraviolet (UV) light. In this case, the inkjet printing device 100 includes a UV exposure unit for exposing the ink on the recording medium 124 to the UV light, instead of a heat and pressure fixing unit (fixing roller 188) based on the heat roller. In this way, in the case of using an ink containing an active light-curable resin, such as an ultraviolet-curable resin, means configured to irradiate the active light, such as a UV lamp or an ultraviolet LD (laser diode) array, is provided instead of the fixing roller 188 for fixing by heating.

(Paper Output Unit)

As illustrated in FIG. 6, subsequently to the fixing unit 120, the paper output unit 122 is provided. The paper output unit 122 includes an output tray 192. Provided between the output tray 192 and the fixing drum 184 of the fixing unit 120 are a transfer drum 194, conveyance belt 196, and tension roller 198 so as to face the tray 192 and drum 184 in a contacting manner. The recording medium 124 is sent by the transfer drum 194 to the conveyance belt 196 and output to the output tray 192. A paper sheet conveyance mechanism by the conveyance belt 196 is not specifically illustrated, but the recording medium 124 after printing is conveyed, with the leading end thereof being held by a gripper on a bar (not illustrated) spanned across the endless conveyance belts 196, above the output tray 192 due to the rotation of the conveyance belts 196.

The inkjet printing device 100 includes an ink storing/loading unit supplying the ink to the inkjet heads 172M, 172K, 172C, and 172Y, and means configured to supply the treatment liquid to the treatment liquid deposition unit 114. Further, the inkjet printing device 100 includes a head maintenance unit for carrying out cleaning of the inkjet heads 172M, 172K, 172C, and 172Y (nozzle surface wiping, purging, nozzle suctioning or the like), a position detecting sensor for detecting a position of the recording medium 124 on a paper sheet conveyance path, and a temperature sensor for detecting a temperature of each unit in the device.

[Exemplary Configuration of Inkjet Head]

Next, a description is given of a configuration of the inkjet head. The configurations corresponding to the inkjet heads 172M, 172K, 172C, and 172Y are common, and thus, hereinafter, a reference numeral 250 designates the head representing these.

Figure 7A:
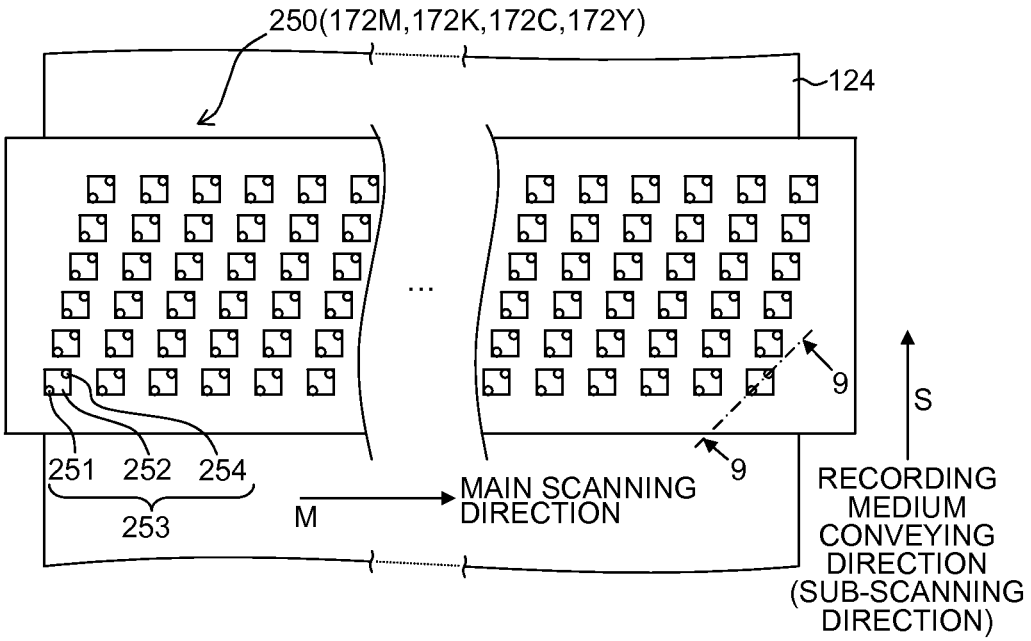
FIG. 7A is a plan transparent view illustrating an exemplary structure of a head.
Figure 7B:
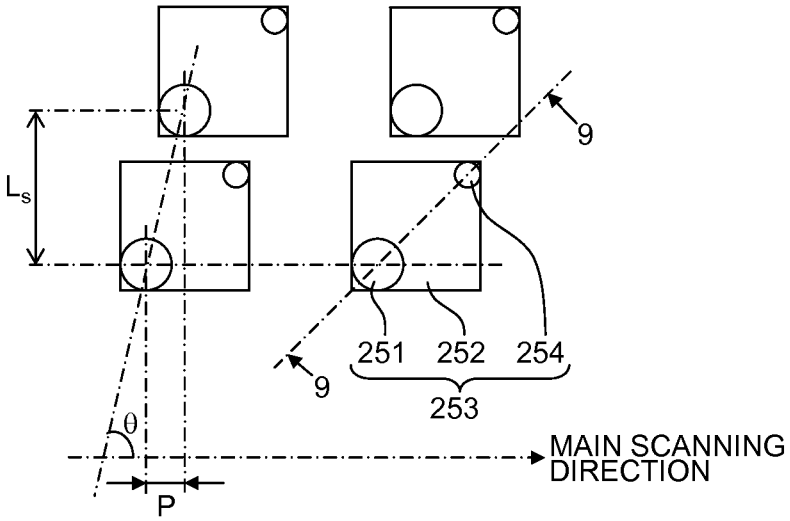
FIG. 7B is a partial enlarged view illustrating an exemplary structure of the head.
Figure 8A:
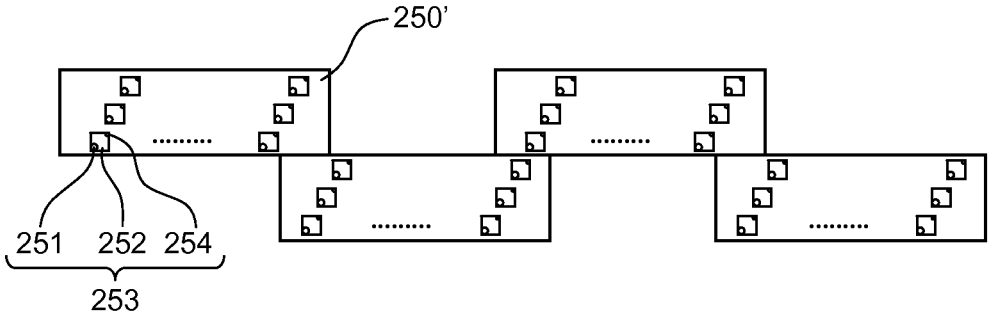
FIG. 8A is a plan view illustrating an exemplary arrangement of a plurality of head modules included in the head.
Figure 8B:
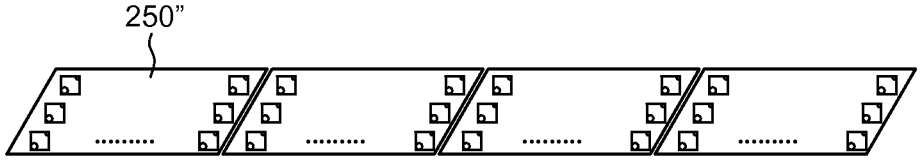
FIG. 8B is a plan view illustrating another exemplary arrangement of a plurality of head modules included in the head.
Figure 9:
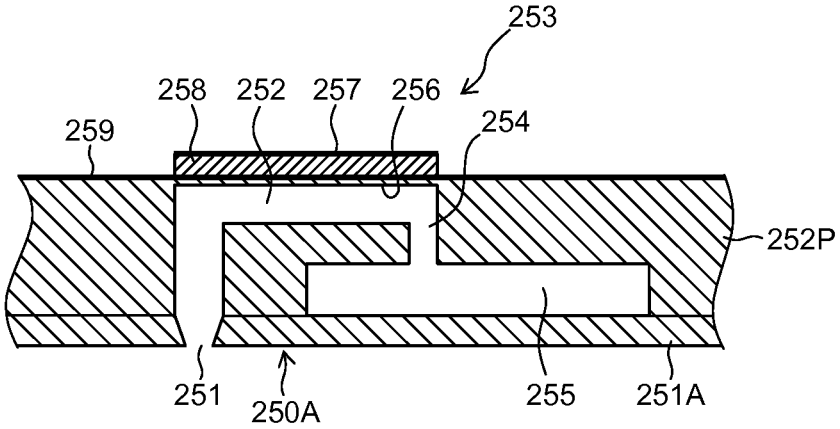
FIG. 9 is a cross-sectional view (cross-sectional view taken along a line 9-9 in FIG. 7A and FIG. 7B) illustrating a droplet ejection element of one channel as a recording element unit (ejection element unit)

FIG. 7A is a plan transparent view illustrating an exemplary structure of the head 250, and FIG. 7B is a partial enlarged view of the same. FIG. 8A and FIG. 8B each are a plan view illustrating an exemplary arrangement of a plurality of head modules constituting the head 250. FIG. 9 is a cross-sectional view (cross-sectional view taken along a line 9-9 in FIG. 7A and FIG. 7B) illustrating a stereo structure of a view illustrating a droplet ejection element of one channel (ink chamber unit corresponding to the nozzle 251) as a recording element unit (ejection element unit).

As illustrated in FIG. 7A and FIG. 7B, the head 250 has a plurality of ink chamber units (droplet ejection elements) 253 arranged in a two-dimensional matrix, each unit 253 including a nozzle 251 as an ink ejection outlet and a pressure chamber 252 corresponding to each nozzle 251. This attains high density of actual nozzle intervals (projection nozzle pitch) which are projected (orthogonally projected) so as to be aligned along a longitudinal direction of the head (direction perpendicular to a paper transfer direction).

In order to configure, in a direction (direction of arrow M; corresponding to "second direction") substantially perpendicular to a transfer direction of the recording medium 124 (direction of arrow S; corresponding to "first direction"), the nozzle row having a length equal to or more than that corresponding to the whole width Wm of the image formation region of recording medium 124, for example, as illustrated in FIG. 8A, a long line-shaped head is configured in which short head modules 250' each having a plurality of nozzles 251 two-dimensionally arranged thereon are arranged in a staggered form. Alternatively, as illustrated in FIG. 8B, an aspect is also possible in which head modules 250" are aligned and combined. The head modules 250' and 250" illustrated in FIG. 8A and FIG. 8B, respectively, correspond to the head modules 12*a* and 12*b* described using FIG. 1 and the like.

The single-pass printing full-line print head is not limited to the case where an overall surface of the recording medium 124 is an image formation range. In a case where a part on the surface of the recording medium 124 is the image formation region (e.g., case where non-image formation region (margin) is defined on a peripheral of the paper sheet), it is sufficient to form the nozzle rows required for the image formation in a predetermined image formation region.

The pressure chamber 252 provided to correspond to the each nozzle 251 has a substantially square planar shape (see FIGS. 7A and 7B), and has an outlet port to the nozzle 251 provided in one corner of a diagonal thereof and an ink inlet port (supply port) 254 provided in the other corner. The shape of the pressure chamber 252 is not limited to this embodiment and various modes are possible in which the planar shape is a quadrilateral shape (diamond shape, rectangular shape, or the like), pentagonal shape, hexagonal shape, or other polygonal shapes, or a circular shape, elliptical shape, or the like.

As illustrated FIG. 9, the head 250 (head module 250' or 250") includes a nozzle plate 251A having the nozzle 251 formed therein, and a flow path plate 252P having a flow path formed therein such as the pressure chamber 252 and a common flow path 255. The nozzle plate 251A and the flow path plate 252P are layered and bonded together. The nozzle plate 251A constitutes a nozzle surface (ink ejection surface) 250A of the head 250 and a plurality of nozzles 251 communicated respectively with the pressure chambers 252 are formed in a two-dimensional arrangement.

The flow path plate 252P is a flow path forming member which constitutes side wall portions of the pressure chambers 252 and defines a supply port 254 serving as a restricting section (most constricted portion) of an individual supply path for guiding the ink to each pressure chamber 252 from the common flow path 255. For the sake of the description, a simplified view is given in FIG. 9, but the flow path plate 252P has a structure formed by layering together one or a plurality of substrates.

The nozzle plate 251A and the flow path plate 252P can be processed into a required shape by a semiconductor manufacturing process using silicon as a material.

The common flow path 255 is communicated with an ink tank (not illustrated) that is an ink source supply. The ink supplied from the ink tank is supplied via the common flow path 255 to the pressure chambers 252.

A diaphragm 256 constitutes a part of the surface of (ceiling surface in FIG. 9) each pressure chamber 252 to which diaphragm a piezoelectric actuator 258 including an individual electrode 257 is bonded. The diaphragm 256 according to this embodiment is made of silicon (Si) having a nickel (Ni) conducting layer which functions as a common electrode 259 corresponding to a lower electrode of the piezoelectric actuator 258, and serves as a common electrode for the piezoelectric actuator 258 which is arranged so as to correspond to each pressure chamber 252. An aspect is also possible in which a diaphragm is made from a non-conductive material such as resin. In this case, a common electrode layer made of a conductive material such as metal is formed on the surface of the diaphragm member. The diaphragm serving as a common electrode may be made also of a metal (conductive material) such as stainless steel (SUS) or the like.

When a drive voltage is applied to the individual electrode 257, the piezoelectric actuator 258 deforms to change the volume of the pressure chamber 252, which causes a pressure change and results in the ink being ejected from the nozzle 251. After ejecting the ink, when the piezoelectric actuator 258 returns to its original state, the pressure chamber 252 is refilled with new ink from the common flow path 255 via the supply port 254.

A plurality of the ink chamber units 253 having such a structure are arranged, as illustrated in FIG. 7B, in a lattice fashion on the basis of a certain arrangement pattern, specifically, in a row direction along a main scanning direction and in a column direction which is inclined at a fixed angle of θ with respect to the main scanning direction and not perpendicular to the main scanning direction, achieving the high dense nozzle head according to this embodiment. In such a matrix arrangement, when the interval between adjacent nozzles in a sub-scanning direction is represented by $L_S$, it can be assumed equivalently that the nozzles 251 in the main scanning direction are substantially arranged linearly at a constant pitch of $P=L_S/\tan\theta$.

In implementing the invention, the arrangement form of the nozzles 251 in the head 250 is not limited to the examples illustrated in the figures, and it is possible to adopt various nozzle arrangement structures. For example, instead of the matrix arrangement illustrated in FIG. 7B, it is possible to use a bent line-shaped nozzle arrangement, such as a V-shaped nozzle arrangement, or a zigzag-shaped nozzle arrangement (W shape or the like) in which a V-shaped nozzle arrangement as a unit is repeated.

The means configured to generate an ejection pressure (ejection energy) for ejecting droplets from the nozzles in the inkjet head is not limited to a piezoelectric actuator (piezoelectric element), and it is also possible to employ various pressure generating elements (ejection energy generating elements), such as a heater (heating element) in a thermal method (method of ejecting ink by using a pressure due to film boiling upon heating by a heater) or various kinds of actuators on the basis of other methods. In accordance with the ejection method of the head, a corresponding energy generating element is provided in the flow path structure.

[Control System of Inkjet Printing Device 100]

Figure 10:
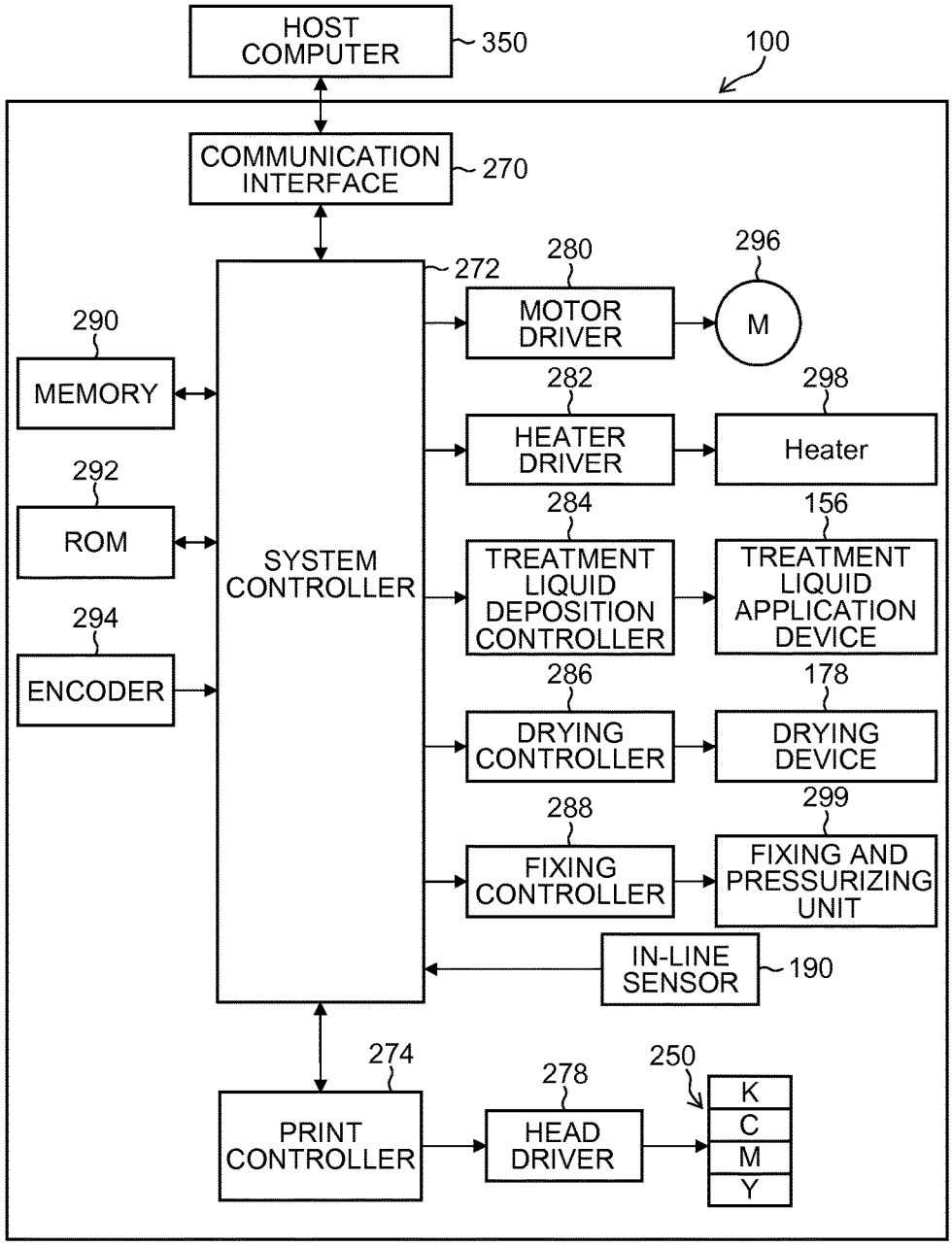
FIG. 10 is a main part block diagram illustrating a system configuration of the inkjet printing device according to an embodiment of the invention.
Figure 11:
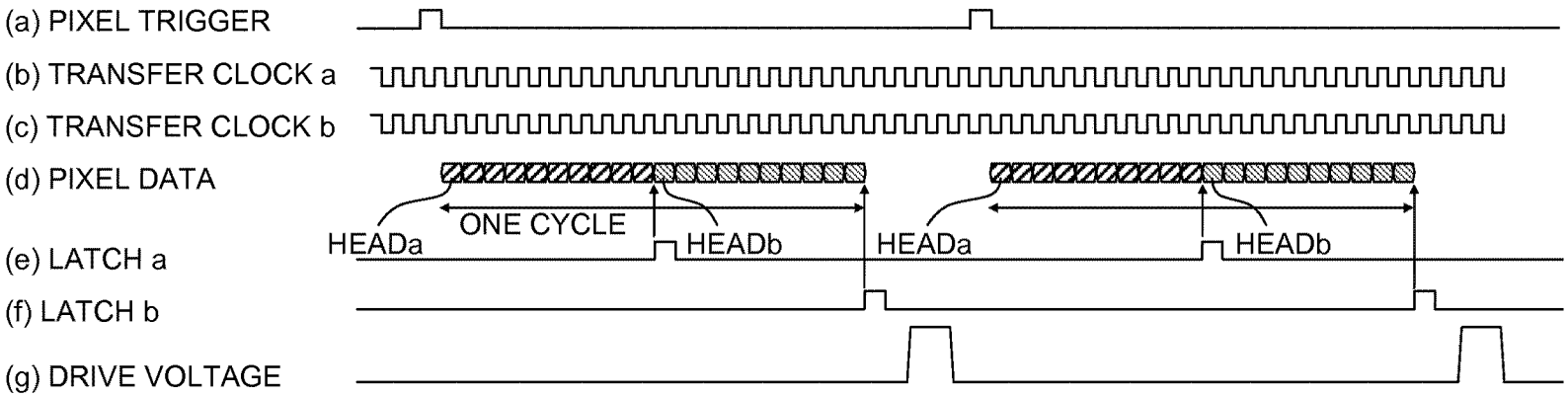
FIG. 11 is a timing chart illustrating a head-driving method of a related art.

FIG. 10 is a main part block diagram illustrating a system configuration of the inkjet printing device 100.

The inkjet printing device 100 includes a communication interface 270, system controller 272, print controller 274, image buffer memory 276, head driver 278, motor driver 280, heater driver 282, treatment liquid deposition controller 284, drying controller 286, fixing controller 288, memory 290, ROM (Read Only Memory) 292, and encoder 294.

The communication interface 270 is an interface unit for receiving the image data sent from a host computer 350. To the communication interface 270, a serial interface such as a USB (Universal Serial Bus), IEEE1394, Ethernet (registered trademark), and wireless network, or a parallel interface such as Centronics interface and the like can be applied. A buffer memory (not illustrated) may be mounted in this portion in order to increase the communication speed. The image data sent from the host computer 350 is input into the inkjet printing device 100 via the communication interface 270, and is temporarily stored in the memory 290.

The memory 290 is storage means configured to temporarily store images inputted via the communication interface 270, and undergoes writing and reading of data via the system controller 272. The memory 290 is not limited to a memory composed of semiconductor elements, and a hard disk drive or another magnetic medium may be used.

The system controller 272 includes a central processing unit (CPU) and peripheral circuits thereof. The system controller 272 functions as a control device for controlling the whole of the inkjet printing device 100 in accordance with a predetermined program. The system controller 272 also functions as a calculation device configured to perform various calculations. Specifically, the system controller 272 controls the various sections, such as the communication interface 270, print controller 274, motor driver 280, heater driver 282, treatment liquid deposition controller 284 and the like, as well as carries out controlling of communications with the host computer 350 and controlling of writing and reading to and from the memory 290. The system controller 272 generates control signals for controlling a motor 296 of the conveyance system, and a heater 298.

The ROM 292 stores therein programs executed by the CPU of the system controller 272, various pieces of data required for controlling, and the like. The ROM 292 may be non-rewritable storage means, or rewritable storage means such as EEPROM (Electronically Erasable and Programmable Read Only Memory). The memory 290 is used as a transient memory area of the image data as well as used as a program deployment area and a work area for calculation by the CPU.

The motor driver 280 is a driver for driving the motor 296 in accordance with an instruction from the system controller 272. In FIG. 10, various motors arranged in the respective units of the device are represented by the reference numeral 296. For example, the motor 296 illustrated in FIG. 10 includes motors in FIG. 6, specifically, a motor for driving rotations of the paper feed drum 152, treatment liquid drum 154, image formation drum 170, drying drum 176, fixing drum 184, transfer drum 194 and the like, a motor for driving a pump which performs negative pressure suction from the suction hole of the image formation drum 170, and a motor of a taking-away mechanism for moving the head unit of the inkjet heads 172M, 172K, 172C, and 172Y to a maintenance area out of the image formation drum 170.

The heater driver 282 is a driver for driving the heater 298 in accordance with an instruction from the system controller 272. In FIG. 10, various heaters arranged in the respective units of the device are represented by the reference numeral 298. For example, the heater 298 illustrated in FIG. 10 includes a pre-heater not illustrated in the figure for heating in advance the recording medium 124 to be at an desired temperature in the paper feed unit 112.

The print controller 274 is a controller which has a signal processing function for performing various processes such as processing and correction for generating print control signals from the image data stored in the memory 290 in accordance with control by the system controller 272 and supplies the generated print data (dot data) to the head driver 278.

In general, the dot data is generated by subjecting multiple-tone image data to the color conversion processing and the halftone processing. The color conversion processing is processing for converting image data represented by a sRGB system or the like (e.g., 8-bit image data for each RGB color) into color data of the respective colors of ink used by the inkjet printing device 100 (e.g., KCMY color data).

The halftone processing is processing for converting the color data of the respective colors generated by the color conversion processing into the dot data of respective colors (e.g., KCMY dot data) by processing using an error diffusion method or a threshold matrix method, or the like.

Required signal processing is carried out in the print controller 274, and the ejection amount and the ejection timing of the ink droplets from the head 250 are controlled via the head driver 278, on the basis of the dot data obtained. By this means, a desired dot size and dot positions can be achieved. The dot data referred here corresponds to the "nozzle control data".

The print controller 274 includes an image buffer memory (not illustrated), and data such as image data and parameters is stored in the image buffer memory temporarily during processing of the image data in the print controller 274. An aspect is also possible in which the print controller 274 and the system controller 272 are integrated to configure a single processor.

A general description is given of the process from image input to printing output. The image data to be printed is input from outside via the communication interface 270 and stored in the memory 290. At this stage, the image data of RGB is stored in the memory 290, for example. The inkjet printing device 100 varies a deposit droplet density or dot size of the fine dot on the basis of the ink (coloring material) to form a continuous tone image pseudo with respect to human eye. For this reason, it is necessary to convert the dot pattern such that a tone of the input digital image (dark/light shading of the image) is reproduced as faithfully as possible. Therefore, an original image (RGB) data stored in the memory 290 is sent via the system controller 272 to the print controller 274, and converted, in the relevant print controller 274, into the dot data for each ink color by the half-toning processing using the threshold matrix method, the error diffusion method or the like. In other words, the print controller 274 performs the processing for converting the input RGB image data into the dot data of four colors of K, C, M, and Y. In this way, the dot data generated in the print controller 274 is stored in the image buffer memory (not illustrated).

The head driver 278 outputs a drive signal for driving the actuator corresponding to each of the respective nozzles in the head 250 on the basis of the print data given from the print controller 274 (i.e., the dot data stored in the image buffer memory 276). The head driver 278 may include a feedback control system for keeping a driving condition for the head at constant.

When the drive signal output from the head driver 278 is added to the head 250, the ink is ejected from the corresponding nozzle. While the recording medium 124 is being conveyed at a predetermined speed, ink ejection from the head 250 is controlled, allowing the image to be formed on the recording medium 124. The inkjet printing device 100 described in this embodiment employs a driving method in which a drive electric power waveform signal that is common in the module unit is applied to each piezoelectric actuator 258 in the head 250 (head module), and on/off of a switch element (not illustrated) is switched in response to the ejection timing of each piezoelectric actuator 258, the switch element being connected to the individual electrode of each piezoelectric actuator 258, and thereby, the ink is ejected from the nozzle 251 corresponding to each piezoelectric actuator 258.

The portion of the head driver 278 and print controller 274 (built in the image buffer memory) corresponds to the head control unit 20 illustrated in FIG. 1 and the like. The system controller 272 in FIG. 10 corresponds to the superior data control unit 30 illustrated in FIG. 1 and the like.

The treatment liquid deposition controller 284 controls the operation of the treatment liquid application device 156 (see FIG. 6) in accordance with an instruction from the system controller 272. The drying controller 286 controls the operation of the solvent drying device (drying device) 178 (see FIG. 6) in accordance with an instruction from the system controller 272.

The fixing controller 288 controls the operation of a fixing and pressurizing unit 299 including the halogen heater 186 and fixing roller 188 in the fixing unit 120 (see FIG. 6) in accordance with an instruction from the system controller 272.

The in-line sensor 190 is a block including an image sensor, as described in FIG. 6. The in-line sensor 190 reads the image printed on the recording medium 124 and detects a printing state (whether or not to eject, variation of deposit droplets, optical density, or the like) by performing a required signal processing or the like to provide the detection result to the system controller 272 and the print controller 274.

The print controller 274 carries out various corrections on the head 250 (ejection failure correction, density correction) on the basis of information obtained from the in-line sensor 190, and performs controlling of preliminary ejection or suction, a cleaning operation such as wiping (nozzle recovering operation), as needed.

Modification Example

The above embodiment describes the inkjet printing device using the method (direct recording method) in which the ink droplet is directly deposited onto the recording medium 124 to form the image, but an applicable scope of the invention is not limited thereto. For example, the invention can apply also to an intermediate transfer type inkjet printing device in which an image (primary image) is formed on an intermediate transfer member on a temporary basis, and the image is transferred on a recording paper sheet in a transfer unit to finally form the image.

The above embodiment describes the inkjet printing device using the page-wide full-line type head which has the nozzle row having a length corresponding to the whole width of the recording medium (single-pass system inkjet printing device that completes the image formation by sub-scanning in one time), but the applicable scope of the invention is not limited thereto. For example, the invention can apply also to an inkjet printing device in which head scanning is performed in plural times with a short recording head, such as a serial type (shuttle scanning type) head, being moved to record the image.

[Means Configured to Relatively Move Head and Paper Sheet]

The embodiment described above illustrates the configuration in which the recording medium is conveyed relative to the stopped head, but in implementing the invention, a configuration is possible in which the head is moved relative to a stopped recording medium (image formation receiving medium).

Application Example of the Invention

The above embodiment is described using application to the inkjet printing device for graphics printing as an example, but the applicable scope of the invention is not limited to this example. For example, the invention can also apply widely to inkjet systems which form the images of various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

What is claimed is:

1. A head-driving method, comprising:

a nozzle control data output step of outputting, to a plurality of head modules arranged in a recording head, nozzle control data for controlling an ejecting operation of nozzles in each of the head modules via a data bus shared between the plurality of head modules with the data being switched sequentially every bit;

a nozzle control data setting step of setting the nozzle control data for each head module to be supplied via the data bus to each of the head modules as nozzle data for each of the head modules by outputting a data latch signal at a timing depending on each of the head modules;

a driving step of outputting a drive voltage signal to an ejection energy generating element for ejecting liquid in each of the head modules to drive the ejection energy generating element; and a varying step of varying a phase of a transfer clock when transferring the nozzle control data to the head module correspondingly to every head module.

2. The head-driving method according to claim 1, wherein in the driving step, the drive voltage signal is applied to the plurality of head modules, the signal being common to the modules.

3. A head-driving method, comprising:

a nozzle control data output step of outputting, to a plurality of head modules arranged in a recording head, nozzle control data for controlling an ejecting operation of nozzles in each of the head modules via a data bus shared between the plurality of head modules with the data being switched sequentially every bit;

a nozzle control data setting step of setting the nozzle control data for each head module to be supplied via the data bus to each of the head modules as nozzle data for each of the head modules by outputting a data latch signal at a timing depending on each of the head modules;

a driving step of outputting a drive voltage signal to an ejection energy generating element for ejecting liquid in each of the head modules to drive the ejection energy generating element; and a generating step of generating N transfer clocks in which in a case where a number of the head modules is N (N is an integer and $N \geq 2$), a period for one clock is equal to a transfer time period required for the nozzle control data of N bits, and the N transfer clocks have phases different from each other corresponding to the N head modules.

4. The head-driving method according to claim 3, wherein in the driving step, the drive voltage signal is applied to the plurality of head modules, the signal being common to the modules.

5. A head-driving method, comprising:

a nozzle control data output step of outputting, to a plurality of head modules arranged in a recording head, nozzle control data for controlling an ejecting operation of nozzles in each of the head modules via a data bus shared between the plurality of head modules with the data being switched sequentially every bit;

a nozzle control data setting step of setting the nozzle control data for each head module to be supplied via the data bus to each of the head modules as nozzle data for each of the head modules by outputting a data latch signal at a timing depending on each of the head modules;

a driving step of outputting a drive voltage signal to an ejection energy generating element for ejecting liquid in each of the head modules to drive the ejection energy generating element; and a reversing step of reversing a phase of the transfer clock when transferring the nozzle control data to two head modules in a case where a number of the head modules is two.

6. The head-driving method according to claim 5, wherein in the driving step, the drive voltage signal is applied to the plurality of head modules, the signal being common to the modules.

* * * * *